US005819520A

United States Patent [19]

Günther

[11] Patent Number: 5,819,520

[45] **Date of Patent: *Oct. 13, 1998**

[54] VENTILATION SYSTEM FOR A MACHINE HAVING AT LEAST ONE ROTATABLE PART

[75] Inventor: Klaus Günther, Leonberg, Germany

[73] Assignee: LTG Lufttechnische GmbH, Stuttgart, Germany

[ * ] Notice: The terminal 16 months of this patent has been disclaimed.

[21] Appl. No.: 371,330

[22] Filed: Jan. 11, 1995

[30] Foreign Application Priority Data

Jan. 11, 1994 [DE] Germany ..... 44 00 506.7

[51] Int. Cl.[6] ..... D01H 5/28; D01H 13/26

[52] U.S. Cl. ..... 57/308; 57/1 R; 57/75; 57/304

[58] Field of Search ..... 57/308, 75, 1 R, 57/304, 58.49

[56] References Cited

U.S. PATENT DOCUMENTS

| | | | |
|---|---|---|---|
| 1,484,724 | 2/1924 | Lent | 57/308 |
| 3,146,572 | 9/1964 | Keyser | 57/1 R |
| 3,378,998 | 4/1968 | Shackelford | 57/308 X |
| 3,412,545 | 11/1968 | Lippuner | 57/304 |
| 3,955,347 | 5/1976 | Schippers | 57/1 R |
| 4,006,033 | 2/1977 | Schewe | 57/304 X |
| 4,036,000 | 7/1977 | Greive | 57/1 R |
| 4,523,441 | 6/1985 | Braybrook et al. | 57/308 X |
| 5,170,615 | 12/1992 | Strhlen et al. | 57/308 X |
| 5,431,004 | 7/1995 | Menegatto | 57/308 |

FOREIGN PATENT DOCUMENTS

| | | | |
|---|---|---|---|
| 3929097 | 3/1991 | Germany | 57/304 |
| 4-24225 | 1/1992 | Japan | 57/304 |
| 2091766 | 8/1982 | United Kingdom | 57/304 |
| 90/05205 | 5/1990 | WIPO | 57/304 |

*Primary Examiner*—William Stryjewski
*Attorney, Agent, or Firm*—Anderson Kill & Olick P.C.

[57] ABSTRACT

A ventilation system for a textile machine, including a separation element functioning as an air filter, for shielding an air blast generated by at least one spindle of a row of spindles supported on a spindle table of the textile machine.

1 Claim, 2 Drawing Sheets

VENTILATION SYSTEM FOR A MACHINE HAVING AT LEAST ONE ROTATABLE PART

BACKGROUND OF THE INVENTION

The present invention relates to a ventilation system for a machine having at least one rotatable part, in particular to a ventilation system for a textile machine.

Machines having at least one rotatable part are well known. A textile machine, for example, has a plurality of rotatable parts, namely, spindles. During operation, such a machine causes not insignificant air movement. Also, the material which is processed on the machine, can cause worsening of air quality.

Accordingly, an object of the invention is to eliminate the above-discussed drawbacks of such machines.

SUMMARY OF THE INVENTION

This and other objects of the invention, which will become apparent hereinafter, are achieved by providing, in a machine with a rotatable part, a separation element formed as a filter and which at least partially shields air movement generated by the rotatable part.

The measures according to the present invention, on one hand, reduce the air movement generated by the rotatable part in the region lying outside of the machine, that is, the separation elements have a throttling function. With regard to a textile machine, the inventive measure substantially reduces the spindle wind generated thereby. On the other hand, the separation element functions as an air filter, that is, it is partially air pervious, so that particles present in the air stream, for example, in the case of a textile machine, loose threads, are filtered.

If, for example, the machine is located in a space associated with an air-conditioning or any other ventilation apparatus, the throttling function of the inventive separation element results in that the air conditioning of the space is not inadmissibly strongly influenced by the air movement generated by the rotatable parts.

The separation element is so formed that, on one hand, it filters loose material particles flying off the rotatable part and carried by the air stream generated by the rotatable part, and on the other hand, exercises a throttling effect on the air stream. The use of the inventive separation element as a filter is particularly advantageous when the textile machine is formed as a ring spindle machine.

Large ring spindle machines may include up to a thousand spindles arranged next to each other. The rotational speed of these spindles is about 12,000–20,000 revolutions per minute, which leads, at corresponding diameters, to a circumferential speed up to 37 m/sec. These spindles cause a twisted stream. This phenomenon is called "spindle wind".

Measurements have shown that flow velocity of the spindle wind adjacent to the spindle is up to 2.5 m/sec. At a distance of 0.5 m from the spindle, the spindle wind has a velocity of 0.5 m/sec. As a result, in the machine vicinity, in particular in the aisle between the machines, air flow velocity is very high. Such spindle wind is especially problematic because the majority of air-conditioning apparatuses generate an air stream, in an aisle between the machines, having also a flow velocity of 0.5 m/sec. Therefore, the spindle wind can impermissibly influence the desired air-conditioning stream.

In addition, the rapidly rotatable spindles, because of their high speed, toss dust and thread material into the aisle between the machines. For understandable reasons, the excessive air contamination cannot be satisfactorily overcome by air-conditioning, because the spindle wind prevents the necessary uniform air flushing of the space by an air-conditioning flow. The inventive separation element not only reduces the air flow in the aisle region between the machines, which favorably influences air-conditioning, but also cleans the air.

The separation element of the present invention is simply formed and is economically manufactured when it is formed as a separation wall. Alternatively, the separation element can be formed as a filter band which unwinds off a dispensing roll located, preferably, at one end of the machine and, at another end of the machine, winds on a pick-up roll.

When the filter band is used only once, it can be made of a simple and rather inexpensive material. However, usually the filter band moves to and fro, that is, it unwinds off the dispensing roll and winds on a pick-up roll, then the band displacement is reversed and the former dispensing roll becomes a pick-up roll. In this case, a multiple use of the filter band is possible.

In accordance with one embodiment, the filter band is formed as a loop-shaped closed filter band, with the filter band and band-supporting reversing rolls forming a complete filter unit, mountable in front of the spindle. The loop-shaped filter band can be so formed that it surrounds the spindle.

When the separation element is advantageously formed as a loop-shaped closed filter band supported on reversing rolls arranged at opposite ends of the machine, a multiple use is substantially facilitated due to continuous rewinding of the filter band. An additional advantage of such a separation element consists in that the loop-shaped filter band can completely surround the rotatable parts.

Advantageously, the separation element is arranged in an outer machine position. This means that it occupies a position which is parallel to the plane of the rotational axes of the spindles. The additional advantage of this consists in that carrying over of thread material, thrown away from a spindle from one machine to another machine, is minimized. This is especially important when different materials are processed on different machines.

For example, if cotton yarns are spun on one machine and polyester yarns are spun on another machine, the carrying over of the thread materials from one machine to the other machine can result in spinning of polyester threads into the cotton yarns. That can present serious problems during coloring of the cotton yarns.

It is also possible to arrange the separation element relative to the rotatable parts, inside the machine, or on both sides of the rotatable parts. This provides yet an additional advantage of reducing the contamination of the machine itself.

According to a further advantageous embodiment of the ventilation system according to the present invention, when it is used with a machine having a plurality of rows of rotatable parts, a separate separation element may be associated with each of the rotatable parts. It is also possible, as in this case, that a common separation element extend along the row of the rotatable parts.

When multiple use of the filter band is contemplated, a device for its cleaning is provided. This cleaning device includes at least one suction nozzle. However, several suction nozzles can be used. For cleaning of the separation element, it is necessary to insure relative movement between the suction nozzle or nozzles and the separation element, to provide for cleaning of the whole surface of the separation element.

To this end, advantageously, the suction nozzle is made stationary when the separation element is displaced, or the suction nozzle is displaced relative to the stationary separation element.

Advantageously, the separation element is made of a cloth or felt material. An electrostatically charging device may be associated with the separation element. This further enhances cleaning the air from thread particles, as the electrostatically charged separation element better attacts the particles.

BRIEF DESCRIPTION OF THE DRAWINGS

The present invention will now be explained in detail with reference to the accompanying drawings, wherein.

DETAILED DESCRIPTION OF THE PREFERRED EMBODIMENTS

Figure 1:
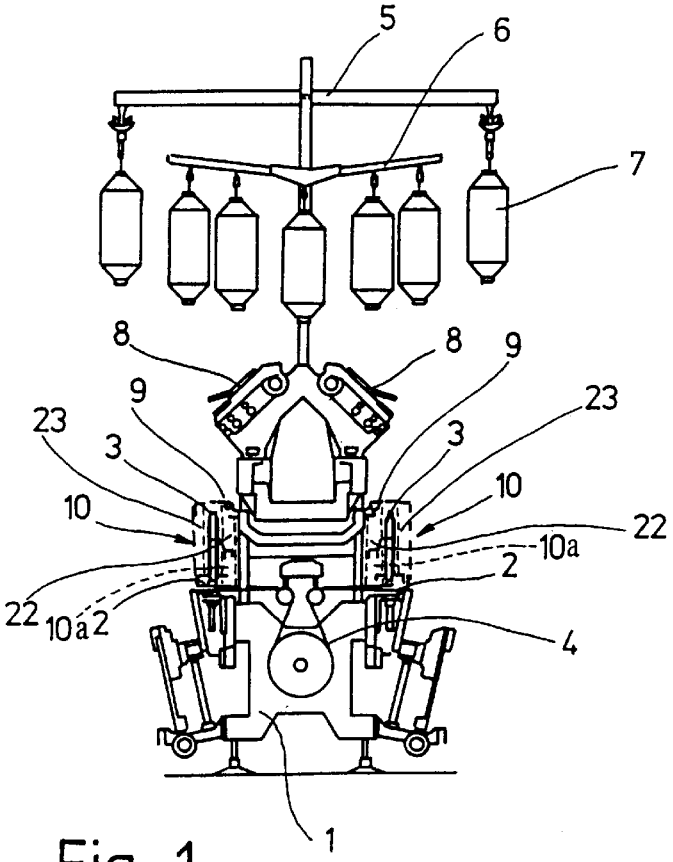
FIG. 1 shows a front view of a textile machine viewed in the direction indicated by arrows in FIG. 2, with a separation element according to the present invention.

FIG. 1 shows a textile machine including a frame 1 provided with a drive formed as a belt drive 4. On opposite sides of the frame 1, two spindle tables 2 are provided, respectively. On each spindle table 2, a plurality of spindles 3, formed as rotatable parts, are arranged in a row. The spindles 3 extend perpendicular to respective tables 2, with free ends thereof pointing upward.

During operation of the textile machine, the spindles 3 are rotated by the belt drive 4. Support devices 5 and 6 for holding a thread material 7 are associated with the frame 1. The textile machine also includes drafting rollers 8 and thread guides 9.

Viewed in a longitudinal direction of a row of spindles 3, machine inner positions 22 and machine outer positions 23 are defined adjacent to respective right side spindles 3. Corresponding positions are associated with respective left side spindles 3 of FIG. 1. Separation elements 10, according to the present invention, are associated with the spindles 3 of each spindle row. The separation elements 10 are arranged sidewise of the spindles 3, extend vertically, and are actually located in a machine outer position 23.

The separation elements 10 are so arranged that they are located in a plane that extends parallel to an imaginary plane which passes through rotational axes of the spindles 3. The separation elements are shown in FIG. 1 with dash lines. The separation elements 10 form separation walls, with their vertical dimensions essentially corresponding to the length of the spindles 3.

It is not necessary to provide the separation elements 10 in the region of machine inner side positions 22, because there the machine structure itself forms a shield for the spindles 3. However, if necessary, the separation elements 10*a* can be provided in this region.

According to the invention, the separation elements 10 are so formed that they are partially pervious to an air stream, and the separation element exercises a strong damping action on the air stream. The separation element 10 also functions as an air filter, that is, it filters particles contained in the air stream which passes therethrough. Advantageously, the separation elements 10 include a cloth or felt material to insure the filtration.

Because of rapidly rotating spindles 3 during operation of the textile machine, a so-called spindle wind is generated. The spindle wind causes an appearance of a twisted air stream. The separation elements 10 dampen to a large degree this spindle wind so that at a short distance from the textile machine, a very small air flow velocity level is present. Simultaneously, as expected, in addition to this throttling action, the particles carried by the spindle wind, such as threads and the like, are filtered by the separation elements 10. Thus, the separation elements 10 enhance air quality and prevent a danger of threads reaching the textile material.

An advantage of using the separation elements according to the invention, also consists in that they prevent, when a plurality of textile machines is used in a limited space, appearance of a strong summary spindle wind, which may result from spindle winds from separate textile machines flowing in the same direction and which is annoying to the operational personnel and, in the case when air-conditioning or the like is used and the resulting summary air stream reaches a high order of magnitude, can adversely affect the ventilation or air-conditioning of the limited space or make the ventilation or air-conditioning even impossible.

The separation elements 10, according to the present invention, so weaken the spindle wind, that the production process can be conducted substantially without air draft and without disturbing the available air conditioning.

Figure 2:
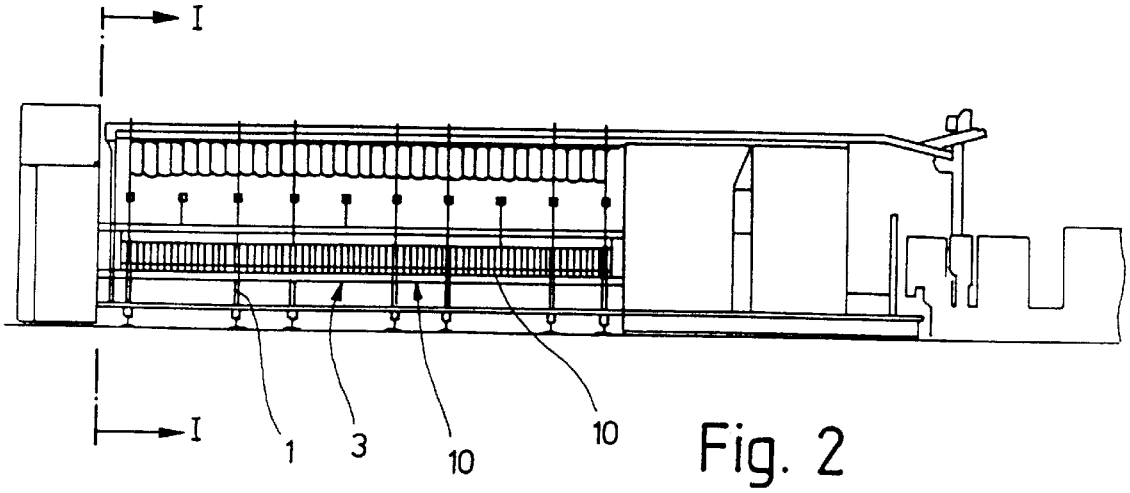
FIG. 2 shows a side view of the textile machine.

FIG. 2 shows a side view of the textile machine shown in FIG. 1. As can be seen in FIG. 2, the separation element 10, formed as a separation wall $\mathbf{10}^1$, extends along the longitudinal extent of the textile machine and shields the corresponding row of spindles 3 which are arranged at the machine outside position 23. The length of the separation wall $\mathbf{10}^1$ approximately corresponds to the length of the textile machine, at least to the length of the region, which includes the rotatable parts, i.e., spindles 3.

Figure 3:
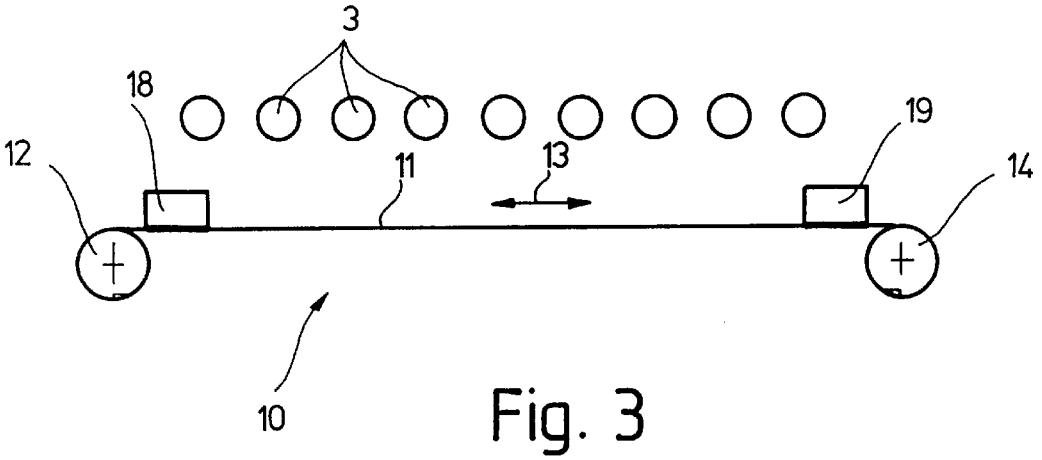
FIGS. 3 and 4 show schematic plan views of the separating element arranged sidewise with respect to rotatable parts of the textile machine.

FIG. 3 shows another embodiment of a separation element 10, according to the present invention, which is associated with a textile machine having a row of spindles 3. For the sake of clarity, the details of the textile machine are not shown in FIG. 3, as well as in FIGS. 4 and 5.

The dimensions of the separation element 10 of the embodiment of FIG. 3 are the same as those described with reference to FIGS. 1 and 2. The difference between the embodiment of the separation element 10, shown in FIG. 3, and the embodiment of the separation element 10 of FIGS. 1 and 2, consists in that the separation element 10 of FIG. 3 is movable whereas the separation element of FIGS. 1 and 2 is stationary.

The separation element 10 of FIG. 3 is formed as a filter band 11, which unwinds off a dispenser roll 12 and is displaced in the direction of arrow 13 and moves sidewise of the spindles 3. The filter band 11 rewinds onto a pick-up roll 14, that is, it can unwind therefrom. At that, the filter band 11 can be cleaned with one or several suction nozzles.

An economical configuration of the filter band according to the foregoing description is represented by a continuously running band, the displacement direction of which is changed when the band is completely unwound from a respective roll. At that, the filter band is continuously cleaned with one or several stationary suction nozzles. Providing the above-described configuration is possible also, when winding up of the filter band is effected in accordance with selected parameters, for example, after a predetermined time interval.

The advantage of the separation element 10 of FIG. 3 consists in that, if necessary, a separation element 10 in a non-loaded condition, can be continuously associated with the spindles 3. When, during operation, the separation element 10 accumulates a substantial amount of filtered particles, the pick-up roll 14 is actuated, and the separation element filter band 10 is displaced a certain amount, and is available for use in a desired condition. In this way it becomes possible to insure maintenance of substantially stable parameters for a long period of time.

If the filter band 11 is to be used after it was completely unwound, suction nozzles 18 and 19 of a cleaning device (not shown in detail) can be provided for cleaning a side of the filter band 11 which is adjacent to the spindles 3. To this end, the filter band 11 can be completely rewound, with the cleaning being conducted during rewinding. Alternatively, it is possible, however, to clean, during operation, only a portion of the filter band 11 which is being used, with the respective nozzle 18 or 19 (in accordance with the filter band displacement in the directions indicated by the double arrow 13).

The displacement or winding directions shown with a double arrow 13, indicate that after completely winding the filter band 11 on one of the rollers 12 and 14, with the filter band 11 being unwound from another of the rollers 12 and 14, the filter band 11 can again be displaced to its original position. Obviously, in the embodiment of FIG. 3, instead of two suction nozzles 18 and 19, only one suction nozzle can be provided.

Figure 4:
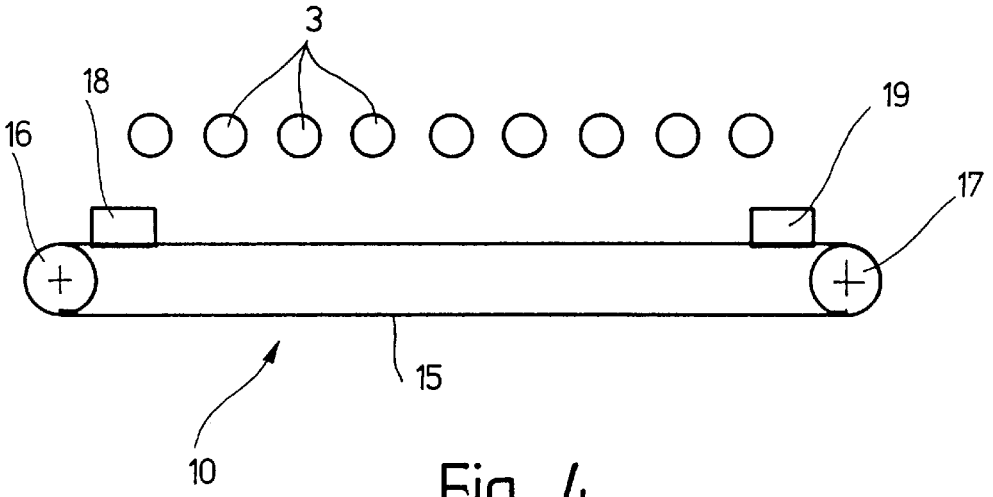

FIG. 4 shows a further embodiment of a separation element 10 according to the present invention, which differs from the embodiment of FIG. 3 in that, instead of a filter band with a finite length, a closed filter band, formed as a loop, is used. The filter band loop 15 winds about reversing rolls 16 and 17 arranged, preferably, in the region of opposite ends of the textile machine.

The reversing rolls 16 and 17 provide a "continuous drive" that takes up the above-described shielding functions. A particularity of this embodiment consists in that a double shield is provided as both band runs, forward and return, take up the shielding function. As in the embodiment of FIG. 3, in the embodiment of FIG. 4, suction nozzles 18 and 19 are provided for cleaning the filter band.

Figure 5:
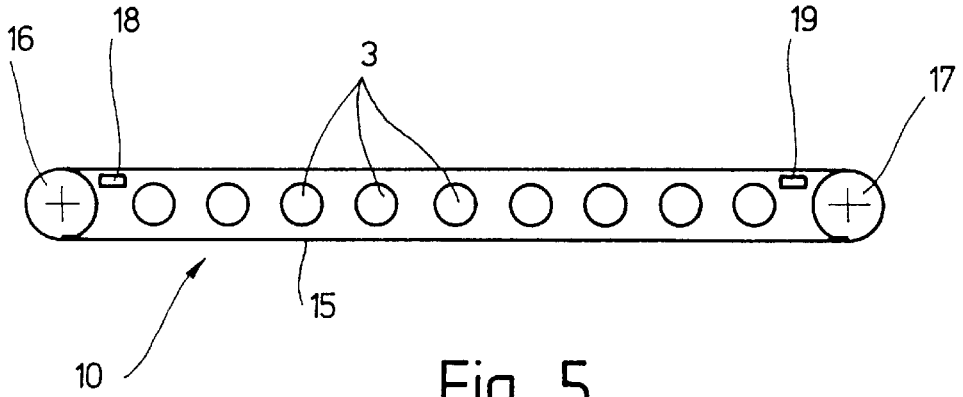
FIG. 5 shows a schematic plan view of another embodiment of a separating element according to the present invention, which surrounds the rotatable parts.

Finally, FIG. 5 shows a structure of a separation element 10 which, as in the embodiment of FIG. 4, is formed of a continuous band drive (filter band 15, reversing rolls 16 and 17), but with the row of the spindles 3 being located inside of the loop of the filter band 15. Thereby, an enveloping shielding of the spindles 3 is achieved. As in the embodiment of FIGS. 2 and 3, suction nozzles 18 and 19 are provided for aspirating, when required, the particles transported by the filter band.

The separation element according to the invention, prevents dust and thread material from being blown into a space surrounding a textile machine, or aisles by spindles rotatable with high speed. The highly turbulent streams in the aisles region of the textile machines are substantially calmed down with the use of separation elements according to the present invention.

The invention also prevents the reduction of the efficiency of air conditioning apparatuses, which may be provided in the respective space.

The filter material of the separation elements, according to the present invention, is so selected that its air permeability corresponds to the intensity of the spindle wind and to the particle precipitation load.

Obviously, the use of the separation elements according to the invention, is not limited to the textile machine but it can be used with any machine which has rotatable parts. For example, the separation element according to the invention can be used with spinning machines, doubling frame machines, etc.

When suction nozzles are used, it is necessary to insure relative movement between the filter element and the suction nozzle. In the discussed embodiment, there are shown stationary suction nozzles and a displaceable filter band. It is, of course, possible to provide a stationary separation element and displaceable suction nozzles.

Furthermore, it is of course possible to provide for displacement of both the separation element and the suction nozzles, so that they displace relative to each other. In case a displaceable suction nozzle is used, a suitable device for displacing the suction nozzle along a predetermined path is provided, with the suction nozzle aspirating particles from a corresponding surface of the separation element.

Thus, though the present invention was shown and described with reference to the preferred embodiments, various modifications thereof will be apparent to those skilled in the art and, therefore, it is not intended that the invention be limited to the disclosed embodiments and/or details thereof, and departures can be made therefrom within the spirit and scope of the appended claims.

What is claimed is:

1. A textile machine, comprising:

a spindle table;

a row of rotatable spindles supported on the spindle table; and ventilation means, wherein the ventilation means comprises a separation element extending substantially vertically sidewise of at least one rotatable spindle for at least partially shielding an air blast generated by the rotatable spindle, the separation element being partially pervious to an air stream for enabling the separation element to act as an air filter, and wherein the textile machine has a constructional element shielding the at least one spindle sidewise on a machine inner side, said separation element which forms another constructional element of the textile machine shielding the at least one spindle on a machine outer side.

* * * * *